US007434666B2

(12) United States Patent
Tyni et al.

(10) Patent No.: US 7,434,666 B2
(45) Date of Patent: Oct. 14, 2008

(54) METHOD AND SYSTEM FOR MEASURING THE STOPPING ACCURACY OF AN ELEVATOR CAR

(75) Inventors: Tapio Tyni, Hyvinkää (FI); Pekka Perällä, Kerava (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/713,677

(22) Filed: Mar. 5, 2007

(65) Prior Publication Data

US 2007/0215413 A1 Sep. 20, 2007

Related U.S. Application Data

(63) Continuation of application No. PCT/FI2005/000401, filed on Sep. 22, 2005.

(51) Int. Cl.
*B66B 1/34* (2006.01)

(52) U.S. Cl. ..... 187/393; 187/293

(58) Field of Classification Search ..... 187/291, 187/293, 295, 247, 391, 393, 394
See application file for complete search history.

(56) References Cited

U.S. PATENT DOCUMENTS 4,128,142 A * 12/1978 Satoh et al. ..... 187/293
4,750,591 A * 6/1988 Coste et al. ..... 187/391
4,751,984 A * 6/1988 Williams et al. ..... 187/293
4,880,082 A * 11/1989 Kahkipuro et al. ..... 187/394
5,035,301 A * 7/1991 Skalski ..... 187/295
5,848,671 A * 12/1998 Kattainen ..... 187/291

FOREIGN PATENT DOCUMENTS

| | | | |
|---|---|---|---|
| DE | 10150284 | A1 | 4/2003 |
| EP | 0 661 228 | A | 7/1995 |
| EP | 0839750 | A2 | 5/1998 |
| JP | 2-239077 | A | 9/1990 |
| JP | 06-100253 | A | 4/1994 |

* cited by examiner

*Primary Examiner*—Jonathan Salata
(74) *Attorney, Agent, or Firm*—Birch, Stewart, Kolasch & Birch, LLP

(57) ABSTRACT

The invention relates to a condition monitoring method and a corresponding system for measuring the stopping accuracy of an elevator car. In the invention, a door zone is defined for each floor, a door zone detector is mounted on the elevator car, the elevator car is moved towards a destination floor, acceleration values of the elevator car are measured during its travel towards the destination floor by means of an acceleration sensor attached to the elevator car and the distance of the stopped elevator from the edge of the door zone is calculated on the basis of the measured acceleration values.

12 Claims, 3 Drawing Sheets

METHOD AND SYSTEM FOR MEASURING THE STOPPING ACCURACY OF AN ELEVATOR CAR

This application is a Continuation of co-pending PCT International Application No. PCT/FI2005/000401 filed on Sep. 22, 2005, which designated the United States, and on which priority is claimed under 35 U.S.C. § 120. This application also claims priority under 35 U.S.C. § 119(a) on Patent Application No(s). 20041241 filed in Finland on Sep. 27, 2004. The entire contents of each of the above documents is hereby incorporated by reference.

FIELD OF THE INVENTION

The present invention relates to elevator systems. In particular, the present invention concerns a method and a system for measuring the stopping accuracy of an elevator car for condition monitoring.

BACKGROUND OF THE INVENTION

For practical operation of elevator systems, it is important that the elevator car should stop at the desired position at a floor. In other words, the stopping accuracy of the elevator car has to be within a certain tolerance. It is clear that if the floor of the elevator car remains e.g. 15 cm above the floor level, there is something wrong with the control of stopping.

In new elevator systems, the elevator control system generally comprises an integrated location system. This allows the stopping accuracy of the elevator car to be monitored and, if necessary, corrected on the basis of accumulated stopping accuracy data. However, not all elevator systems have an integrated system for monitoring the stopping accuracy of the elevator.

Based on the monitoring of stopping accuracy, it is possible to control e.g. the condition of the brakes used to decelerate the elevator car and the operation of the car load weighing device. Defective operation of the brakes naturally results in an inaccuracy of stopping of the elevator car.

In prior art, the stopping accuracy of an elevator car has also been determined using e.g. a magnetic zone. A magnetic zone is a zone of a few centimeters, within which the elevator car should stop in a normal situation. A measurement utilizing a magnetic zone only indicates whether the elevator car stopped within that zone or not. Therefore, magnetic zone measurement does not give any precise information regarding stopping accuracy. In other methods of measuring stopping accuracy, e.g. various detectors are used to indicate the position where the elevator car stops. A problem with the use of detectors is that they are very difficult to mount at a precise position. If the detectors are not mounted at exactly the right positions, then the measurement of stopping accuracy of the elevator car is no longer accurate.

Naturally, to allow measurement of the stopping accuracy of an elevator car, solutions capable of accurate measurement of the stopping accuracy of the elevator car can be installed in the elevator car, in the elevator shaft and/or in the machine room. However, such solutions are expensive, and they are not reasonable for mass production in respect of their price/quality ratio.

It is possible to calculate the position of the elevator car e.g. from acceleration data by first integrating acceleration as velocity and then velocity as position. The problem is that integration is very sensitive to offset-type errors because an error will accumulate over the entire integration cycle. Especially in double integration, the standard error increases quadratically $$\int\int a_0 dt^2 = \frac{1}{2} a_0 t^2 \tag{1}$$

where $a_0$ is the offset term of acceleration measurement. An acceleration sensor can never be mounted in a completely straight position, and besides, due to the car load, the acceleration sensor is always somewhat askew. In addition, electrical resetting of the transducer-amplifier-A/D converter of the chain is never completely free of errors. Due to the above-mentioned reasons, vertical acceleration measurement of the car always contains a constant term $a_0=a_m+a_e+n$, where $a_m$ is a constant error caused by mechanical factors, $a_e$ is the reset error of the electric chain and n is the measurement noise. The constant term $a_0$ accumulates into position measurement according to equation (1). The average measurement noise is zero and its effect disappears in the integration process. The constant term arising from the tilt error is $$a_m=(1-\cos\alpha)\cdot g \tag{2}$$

where $\alpha$ is the tilt angle from the horizontal plane and g is the acceleration 9.81 $m/s^2$ of the Earth. If the elevator takes e.g. 4.5 s to travel between successive floors (elevator speed 1 m/s, acceleration 0.8 $m/s^2$, distance between floors 3.2 m), then according to equations (1) and (2) e.g. a 2.5-degree tilt error results in an error of about 10 cm in the position integrated from the acceleration measurement. This accuracy is not sufficient for the monitoring of stopping accuracy.

In existing elevators with no accurate location system, there is no sufficiently accurate system for monitoring the stopping accuracy of the elevators. In the course of decennia, there have been tens if not hundreds of elevator manufacturers and consequently even a greater number of different models. For this reason, a most diverse variety of electric and mechanical implementations are found in elevators.

Reference was made above to a stopping window implemented as a magnetic zone, within which the elevator should stop. The tolerance of the stopping window is adjusted mechanically during installation, and the width of the window depends on the implementation of the elevator drive. In simple implementations where it is known that the elevators have poor stopping characteristics, the stopping window is made wide. In the case of the most modern drives, which employ inverters and speed measurement and in which the stopping accuracy should be better by nature, the window is set to a narrower width.

Mechanical basic adjustment and subsequent adjustment/modification of stopping windows is a time-consuming and difficult task. In addition, in present condition monitoring systems, part of the system is typically placed on the top of the car (stopping accuracy data) while some of the signals are obtained from the elevator panel (start command on/off, to indicate whether the elevator is moving). However, a distributed implementation involves problems:

- connection to the elevator control panel and finding the correct signals in it and connecting to them, and
- for data transfer between the devices in the machine room and on the car top, an extra car cable has to be installed.

Based on the circumstances described above, there are considerable drawbacks in present-day condition monitoring systems in existing elevators, especially in respect of measurement and monitoring of stopping accuracy.

OBJECT OF THE INVENTION

The object of the present invention is to disclose a method and system for the measurement of the stopping accuracy of an elevator car, which method and system will also solve the problems described above. The bearing idea of the invention is to utilize the rest-to-rest property of the elevator operating cycle for calibration of the measurement and to make the error-prone double integration of acceleration required for the computation of distance as brief as possible.

BRIEF DESCRIPTION OF THE INVENTION

As for the features of the present invention, reference is made to the claims.

The invention concerns a condition monitoring method for the measurement of the stopping accuracy of an elevator car. In the method according to the invention, a door zone is defined for each floor, a door zone detector is mounted on the elevator car, the elevator car is moved towards a destination floor, the acceleration values of the elevator car are measured by means of an acceleration sensor attached to the elevator during the passage towards the destination floor and the distance of the stopped elevator to the edge of the door zone is calculated on the basis of the measured acceleration values.

In an embodiment of the invention, a computational final velocity of the elevator car is calculated on the basis of the measured acceleration values, said acceleration values being measured during the time span from the departure of the elevator car to its stopping back in position, an average acceleration error is calculated from the computational final velocity, corrected acceleration values are calculated using the average acceleration error, and the distance of the stopping position of the elevator car to the edge of the door zone is calculated on the basis of the corrected acceleration values.

In an embodiment of the invention, the departure and stopping of the elevator car are detected from the acceleration values measured by the acceleration sensor.

In an embodiment of the invention, the acceleration values measured by the acceleration sensor attached to the elevator car are stored in a data buffer from the moment the elevator car passes the edge of the door zone until the car stops, and the corrected acceleration values are stored in the data buffer after the calculation of the average acceleration error.

In an embodiment of the invention, based on the corrected acceleration values, the door zone velocity of the elevator car is calculated at the point when the elevator car passes the edge of the door zone, and, based on the calculated door zone velocity, the distance of the stopped elevator car to the edge of the door zone is calculated.

In an embodiment of the invention, the recurrence of stoppages relative to the edge of the door zone is monitored.

In an embodiment of the invention, the results of the calculation of stopping distances of the elevator car from the edge of the door zone are transmitted over a wired or wireless connection to a condition monitoring system.

The invention also relates to a condition monitoring system for the measurement of the stopping accuracy of an elevator car. The system of the invention comprises at least one elevator, floor-specific door zones, a door zone detector on the elevator car, an acceleration sensor arranged to measure acceleration values of the elevator car during its travel towards a destination floor, and calculating means (100) for the calculation of the distance of the elevator to the edge of the door zone on the basis of the measured acceleration values.

In an embodiment of the invention, the calculating means have been arranged to calculate a computational final velocity of the elevator car on the basis of the measured acceleration values, said acceleration values being measured during the time span from the departure of the elevator car to its stopping back in position, an average acceleration error by using the computational final velocity, corrected acceleration values by using the average acceleration error, and, based on the corrected acceleration values, the distance of the stopping position of the elevator car to the edge of the door zone.

In an embodiment of the invention, the calculating means have been arranged to detect the departure and stopping of the elevator car from the acceleration values measured by the acceleration sensor.

In an embodiment of the invention, the system further comprises a data buffer for storing the acceleration values measured by the acceleration sensor attached to the elevator car from the moment the elevator car passes the edge of the door zone until the car stops and for storing the corrected acceleration values after the calculation of the average acceleration error. In an embodiment of the invention, the calculating means have been arranged to calculate, based on the corrected acceleration values, the door zone velocity of the elevator car at the point when the elevator car passes the edge of the door zone and to calculate, based on the calculated door zone velocity, the distance of the stopped elevator car from the edge of the door zone.

In an embodiment of the invention, the calculating means have been arranged to monitor the recurrence of stoppages relative to the edge of the door zone.

In an embodiment of the invention, the system further comprises a transmitter arranged to transmit the results of the calculation of stopping distances of the elevator car from the edge of the door zone over a wired or wireless connection to the condition monitoring system.

The present invention has several advantages as compared to prior art. The solution of the invention is sufficiently accurate for condition monitoring of an elevator. In addition, the essential components (acceleration sensor, door zone detector on the elevator car and for floor-specific door zones) of the system of the invention are simple and cheap.

The invention also has the advantage that the essential components (acceleration sensor, door zone detector on the elevator car and for floor-specific door zones) of the system can be easily and quickly installed for use. As the invention does not involve measurement of an absolute position/distance of the elevator car, the floor-specific door zones need not necessarily be located at certain positions with an absolute accuracy. Moreover, the acceleration sensor can be integrated on the circuit board of a condition monitoring device.

As compared to prior art, the invention also has the advantage that the system of the invention is a self-learning system, which learns the distance to a reference point. In addition, the stopping accuracy of the frequency of distance is obtained from the same acceleration measurement that is also used for many other condition monitoring purposes: location of car in elevator shaft, riding comfort (vertical vibrations), monitoring of car status (e.g. car stationary, being accelerated, etc.).

The invention also has the advantage that the disclosed condition monitoring solution is completely separate from the actual elevator control system. The solution of the invention does not require any data from the elevator control panel because in this solution the start command of the elevator is deduced from the acceleration data. Therefore, the solution of the invention needs no connection to the control panel in the machine room, and thus no extra car cable is needed, either.

In addition, the solution of the invention indicates a linear location to the edge of the door zone and no on/off-type data to a stopping window set mechanically beforehand. Alarm limits can be changed any time e.g. from a maintenance center. In other words, to change the alarm limits, no mechanical configuring or adjusting is needed at all.

LIST OF FIGURES

In the following, the invention will be described in detail with reference to embodiment examples, wherein FIG. 1 presents an elevator system according to the invention;

DETAILED DESCRIPTION OF THE INVENTION

Figure 1:
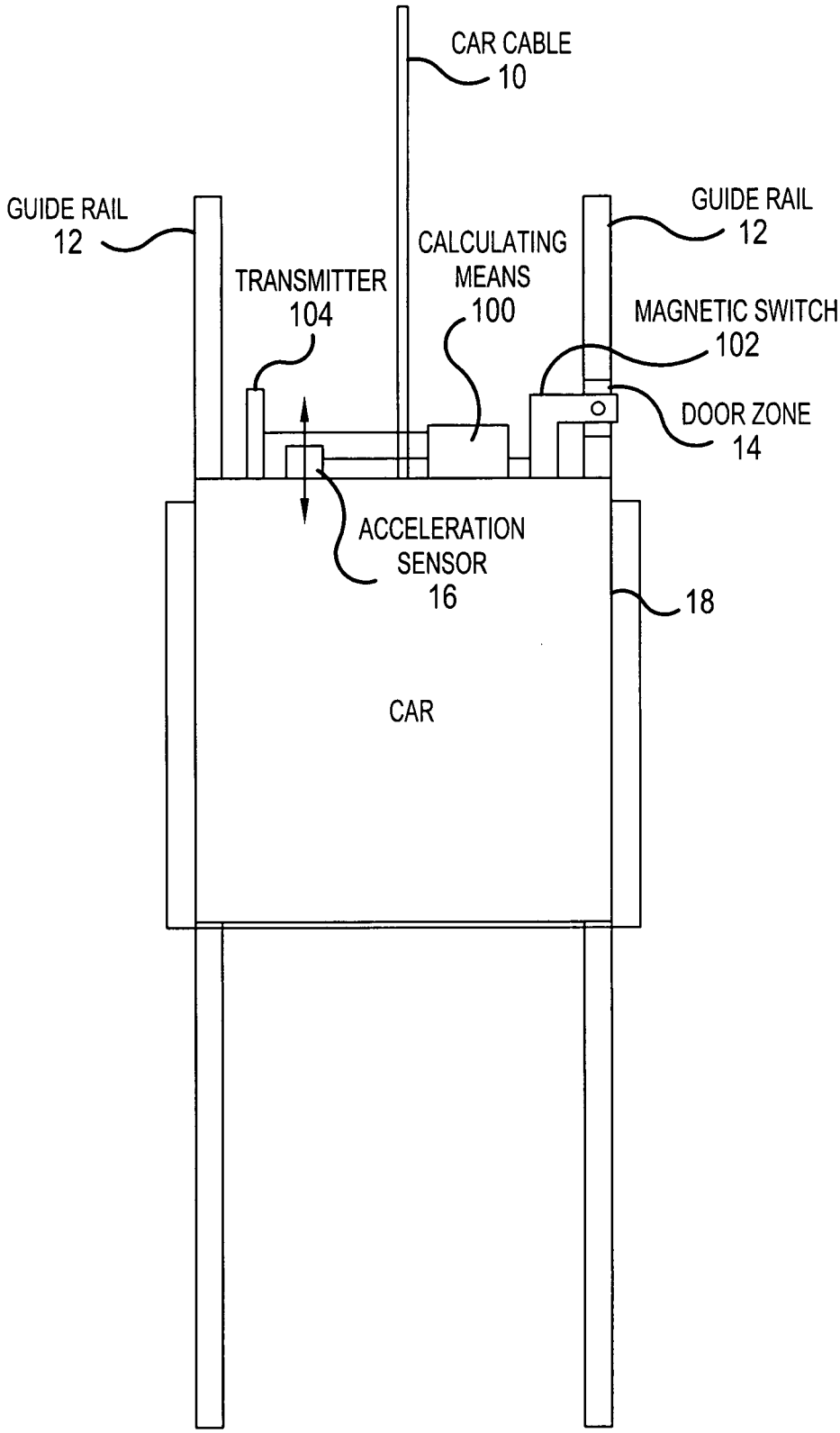

FIG. 1 presents an elevator system according to the invention. An elevator car 18 controlled by a car cable 10 moves along guide rails 12. Installed on the elevator car 18 is an acceleration sensor 16, which is used to measure vertical acceleration of the elevator car 18. The acceleration sensor 16 can be installed on the elevator car 18 expressly for an embodiment of the invention or alternatively the invention can be implemented utilizing an acceleration sensor already existing on the elevator car. In addition, arranged on or near the elevator car 18 are calculating means 100 for the calculation of the distance of the elevator car from the edge of the door zone on the basis of the measured acceleration values. The calculating means 100 are implemented using e.g. a processor and a memory arranged in connection with it or completely via software.

At every floor, a device or arrangement indicating a door zone 14 is installed. The door zone 14 can be E.g. marked by upper and lower reference points. The length of the door zone 14 is e.g. 15 cm in both directions. The apparatus detecting the door zone 14 may consist of e.g. traditional, flexible magnets mounted on a guide rail. In this case, the elevator car 18 is provided with e.g. a magnetic switch 102 ("cigar switch") mounted to move with the elevator car 18. In another embodiment, instead of magnet, a reflecting surface is used as the door zone 14 and an optical component as the switch 102.

As stated above, the vertical motion of the elevator car 18 is measured by means of an acceleration sensor 16. The sensor used may be an economical but accurate MEMS-based (Micro-Electro-Mechanical-Sensor) sensor, such as those manufactured e.g. by VTI Technologies (www.vti.fi) and Analog Devices (www.analog.com).

Figure 2:
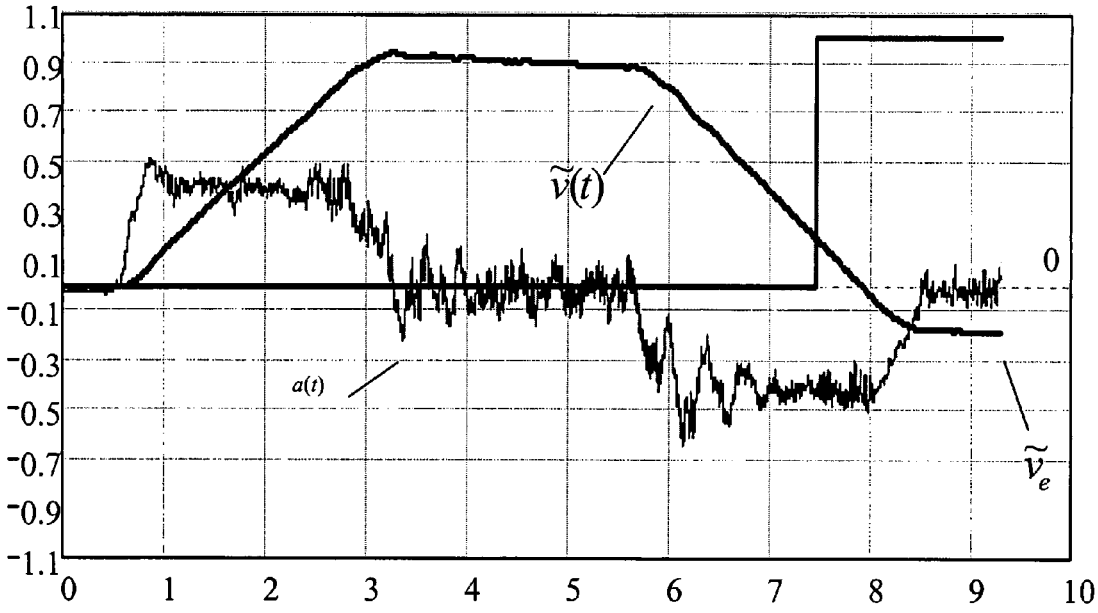
FIG. 2 is a graph showing an acceleration and velocity curve during the travel of an elevator car.

The operating sequence of the elevator provides the possibility to calibrate the mounting angle of the acceleration sensor 16 during normal operation of the elevator. The calibration can be based on the fact that the velocity of the elevator is zero at the beginning and end of the operating cycle of the elevator car. In FIG. 2, the velocity v has been integrated from the acceleration measurement. At the end of the operating cycle, when the velocity of the elevator car is zero, the integrated velocity still contains the final velocity $$\tilde{v}_e = v_0 + \int_0^T \tilde{a}(t)dt = -0.191 \text{ m/s}$$

where $v_0=0$ is the initial velocity of the elevator at the beginning of the operating cycle and the time consumed during the operating cycle is T=9.3 s. Acceleration $$\tilde{a}_k = a_k + a_0 \tag{3}$$

sampled from non-stop acceleration $\tilde{a}(t)$ also contains the offset error ($a_0$) of the measurement.

Figure 3:
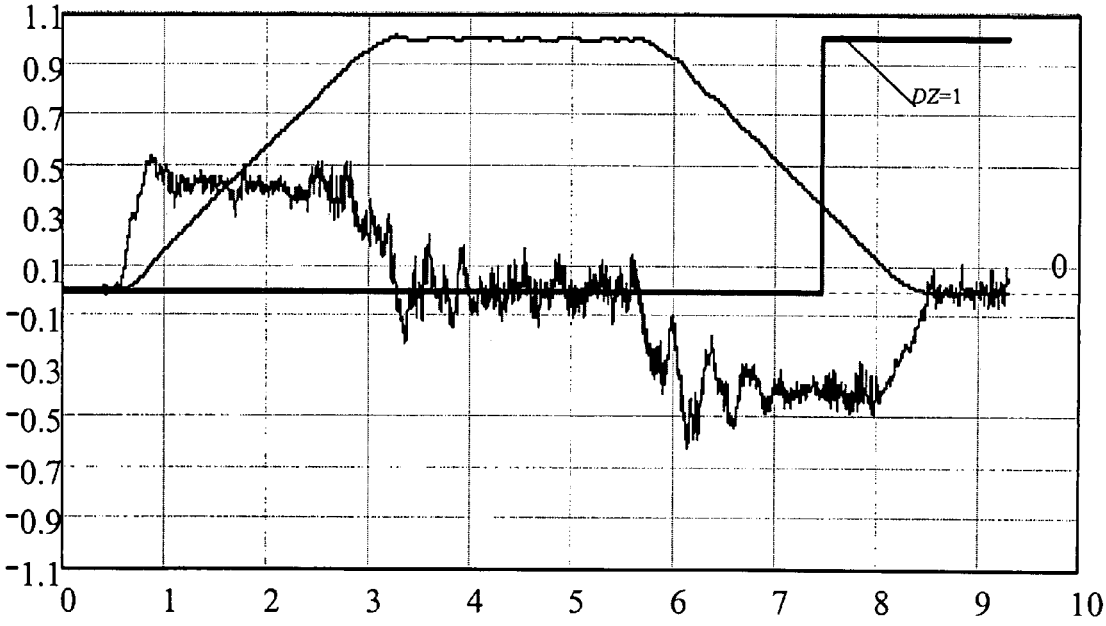
FIG. 3 is a graph showing a corrected acceleration and velocity curve.

In an embodiment of the invention, it is not necessary to save into the data buffer 100 the entire long passage to the desired destination floor, but the integration can be approximated numerically during the travel of the elevator; for example, utilizing the trapezoid formula, which gives $$\tilde{v}_k = \tilde{v}_{k-1} + \frac{1}{2}(\tilde{a}_k + \tilde{a}_{k-1})\Delta t \tag{4}$$

where k is the sample number, N is the number of samples taken during the trip, k=1 . . . N−1, Δt is the time interval between samples, $\tilde{v}_0=0$ and $\tilde{v}_e=\tilde{v}_{N-1}$. Integration by the trapezoid formula (4) requires only one sample $\tilde{a}_{k-1}$ to be held in memory at a time. FIG. 3 presents the acceleration corrected by a calculated offset acceleration $$a_k = \tilde{a}_k - a_0 \tag{5}$$

and the velocity profile obtained from it. As can be seen from FIG. 3, the integrated final velocity now becomes zero. In the present invention, no recalculation of velocity needs to be performed in the final application, and it is only described here to clarify the matter.

The arrival of the elevator car in the door zone 14 is seen from the activation of a reference switch (in FIG. 3, DZ=1, (DZ, Door Zone)). According to an embodiment of the invention, at this moment the system starts saving the measured acceleration samples into the data buffer 100 of the condition monitoring device. The saving is carried on e.g. until the elevator car 18 has stopped. After this, a computational final velocity is calculated by formula (4) during the travel. From the computational final velocity, the average offset acceleration having prevailed during the operating cycle can be calculated:

$$a_0 = \frac{\tilde{v}_e - v_e}{T} = \frac{\tilde{v}_e - v_e}{N \cdot \Delta t} \tag{6}$$

where $v_e=0$ is the actual final velocity of the elevator 18 at the end of the operating cycle and T is the time consumed by the operating cycle. The offset error contained in the acceleration samples in the data buffer 100 is then eliminated by formula (5). In the case of the example, the average offset acceleration obtained is $a_0=-0.021$ m/s$^2$. After this action, the data buffer 100 contains a number of corrected acceleration values. If samples are taken at a sampling frequency of about 1 kHz, then the required data buffer 100 size is about 3 kilosamples.

Figure 4:
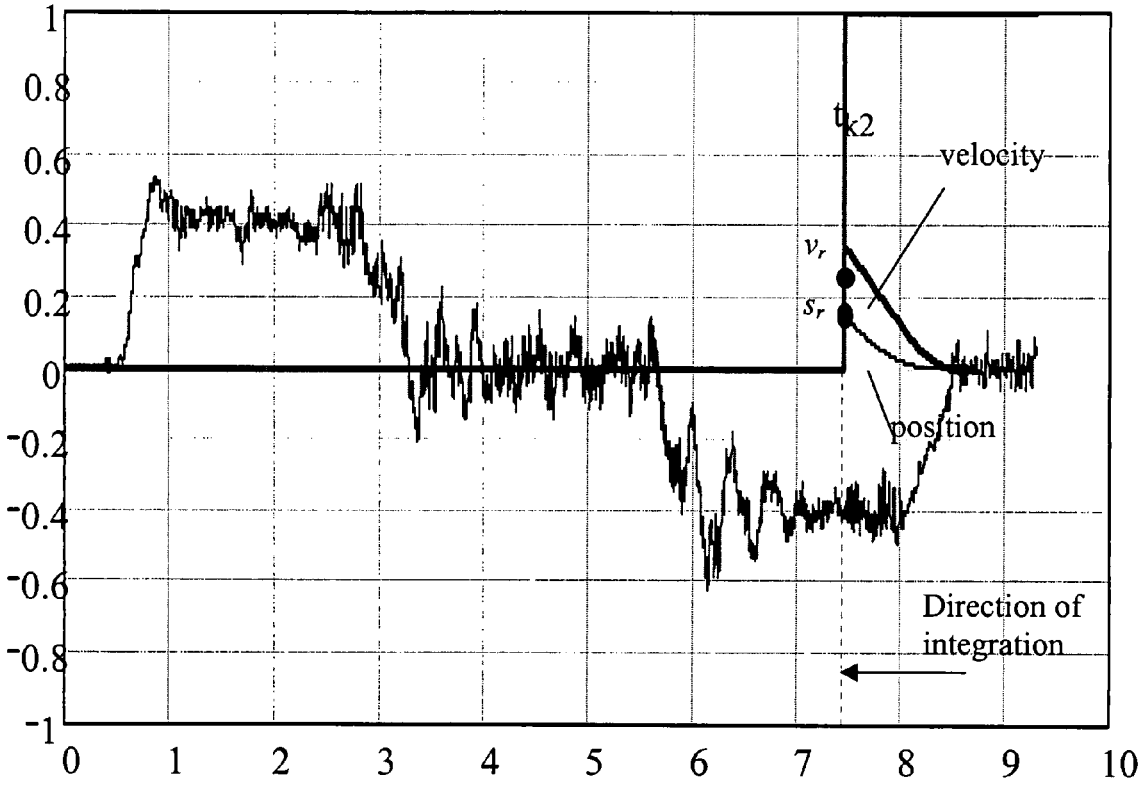
FIG. 4 is a graph showing a corrected acceleration curve, a calculated door zone velocity and the distance of the elevator car from the edge of the door zone.

After the steps described above, the data buffer 100 of the condition monitoring device contains corrected acceleration measurements starting from the instant when the elevator car 18 entered the door zone 14 up to the instant when the elevator car 18 stopped. When the elevator car 18 reaches the door zone 14, its velocity is not known with sufficient accuracy, whereas the final velocity is known exactly; the final velocity after the elevator car 18 has stopped is zero. It is now possible to reverse the situation and use the final velocity as initial velocity and start integrating in the reverse direction along the measured acceleration curve. The aim is to determine the velocity $v_r$ of the elevator on reaching the door zone 14 and then, utilizing the velocity profile, to establish the distance $s_r$ of the stopped elevator car to the edge of the door zone 14. FIG. 4 shows the door zone velocity $v_r$ of the elevator car 18 determined from the corrected acceleration measurements and the distance $s_r$ of the stopped elevator car 18 to the edge of the door zone 14. In the case of FIG. 4, the velocity $v_r$ of the elevator car 18 as it reaches the door zone 14 is 0.343 m/s and the distance of the stopping position to the edge of the door zone 14 is 0.150 m.

In summary, the solution of the invention can be used to monitor the recurrence of stoppages relative to the edge of the door zone.

Figure 5:
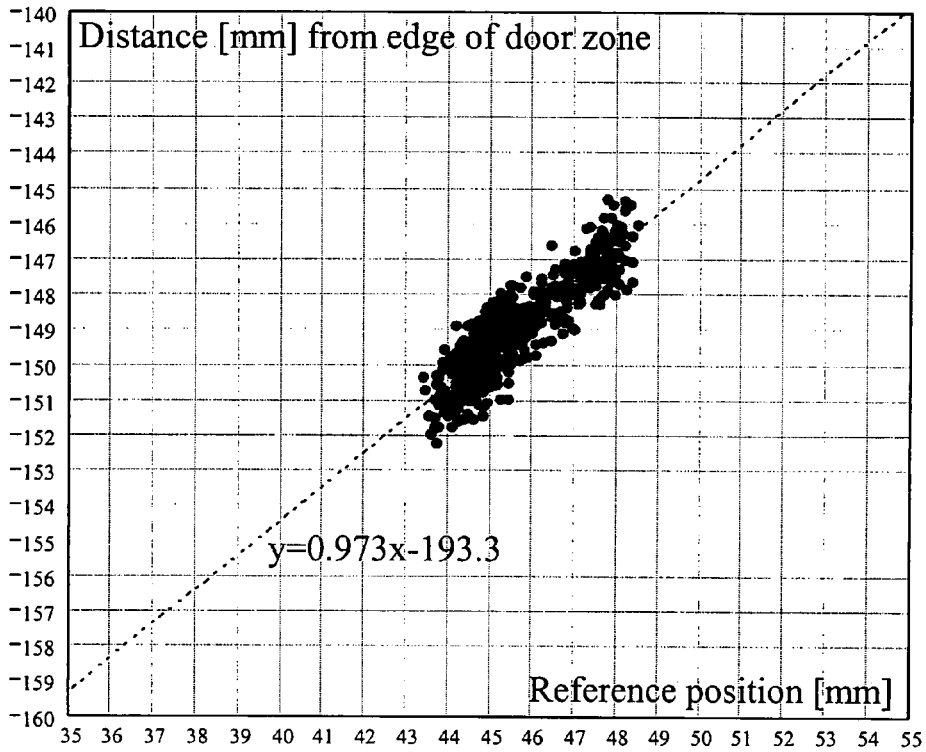
FIG. 5 is a graph presenting a test ride from a number of stoppages.

FIG. 5 presents experimental results for 590 stoppages. In the results, the elevator has been moved from the first floor to the third floor. The actual stopping position of the elevator was measured by an accurate absolute sensor. The vertical axis represents the distance to the edge of the door zone as calculated by the present method. The door zone sensor was an optical sensor. Adapted to the point cloud in FIG. 5 is a straight regression line y=Ax+B. As a result of the adaptation, the coefficient A receives the value 0.973, in other words, a millimeter measured by the method is in reality 1/0.973 mm, the relative error thus being 2.7%.

It is to be noted that, in the results presented in FIG. 5, the elevator was moved from a lower level to a given upper floor. When more comprehensive information regarding stopping accuracy at a given floor is desired, the elevator is moved to the given floor from both below and above and the stopping accuracy is monitored separately for each direction.

The condition monitoring system of the invention may further comprise a transmitter 104, which has been arranged to send results of calculated stopping distances of the elevator car 18 from the edge of the door zone 14 over a wired or wireless connection to the condition monitoring system. Accumulated information about stoppages of the elevator car at each floor is sent by the transmitter e.g. on a periodic basis.

The method and system of the invention are characterized by what is disclosed in the characterization parts of the claims below. Other embodiments of the invention are characterized by what is disclosed in the claims below. Inventive embodiments are also presented in the description part of the present application. The inventive content disclosed in the application can also be defined in other ways than is done in the claims below. The inventive content may also consist of several separate inventions, especially if the invention is considered in the light of explicit or implicit subtasks or in respect of advantages or sets of advantages achieved. In this case, some of the attributes contained in the claims below may be superfluous from the point of view of separate inventive concepts.

It is obvious to the person skilled in the art that the invention is not limited to the embodiments described above, in which the invention has been described by way of example, but that different embodiments of the invention are possible within the scope of the inventive concept defined in the claims presented below.

The invention claimed is:

1. A condition monitoring method for measuring the stopping accuracy of an elevator car, the method comprising the steps of:
- defining a door zone for each floor;
- mounting a door zone detector on the elevator car;
- moving the elevator car towards a destination floor;
- measuring acceleration values of the elevator car during its travel towards the destination floor by means of an acceleration sensor attached to the elevator car;
- calculating the distance of the stopped elevator from the edge of the door zone on the basis of the measured acceleration values;
- calculating a computational final velocity of the elevator car on the basis of the measured acceleration values, said acceleration values being measured during the time span from the departure of the elevator car to its stopping back in position;
- calculating an average acceleration by utilizing the computational final velocity;
- calculating corrected acceleration values by utilizing an average acceleration error; and
- calculating the distance of the stopping position of the elevator car to the edge of the door zone on the basis of the corrected acceleration values.

2. The method according to claim 1, further comprising:
- detecting the departure and stopping of the elevator car from the acceleration values measured by the acceleration sensor.

3. The method according to claim 1, wherein
- the acceleration values measured by the acceleration sensor attached to the elevator car are stored in a data buffer from the instant when the elevator car passes the edge of the door zone until the elevator car stops; and
- the corrected acceleration values are stored into the data buffer after the calculation of the average acceleration error.

4. The method according to claim 3, further comprising:
- calculating on the basis of the corrected acceleration values the door zone velocity of the elevator car at the point when the elevator car passes the edge of the door zone; and,
- calculating on the basis of the calculated door zone velocity the distance of the stopped elevator car to the edge of the door zone.

5. The method according to claim 1, further comprising:
- monitoring the recurrence of stoppages relative to the edge of the door zone.

6. The method according to claim 1, further comprising:
- transmitting the results regarding the calculated stopping distances of the elevator car from the edge of the door zone over a wired or wireless connection to a condition monitoring system.

7. A condition monitoring system for the measurement of stopping accuracy of an elevator car, comprising:
- at least one elevator;
- floor-specific door zones;
- a door zone detector on the elevator car;
- an acceleration sensor arranged to measure acceleration values of the elevator car during its travel towards a destination floor; and
- calculating means for the calculation of the distance of the elevator car to the edge of the door zone on the basis of the measured acceleration values, the calculating means being arranged to calculate:
- a computational final velocity of the elevator car on the basis of the measured acceleration values, said acceleration values being measured during the time span from the departure of the elevator car to its stopping back in position;

an average acceleration error by using the computational final velocity;

corrected acceleration values by using the average acceleration error; and based on the corrected acceleration values, the distance of the stopping position of the elevator car (18) to the edge of the door zone.

8. The system according to claim 7, wherein the calculating means is arranged to detect the departure and stopping of the elevator car from the acceleration values measured by the acceleration sensor.

9. The system according to claim 7, further comprising a data buffer for storing the acceleration values measured by the acceleration sensor attached to the elevator car from the moment when the elevator car passes the edge of the door zone until the elevator car stops and for storing the corrected acceleration values after the calculation of the average acceleration error.

10. The system according to claim 9, wherein the calculating means is arranged to calculate on the basis of the corrected acceleration values the door zone velocity of the elevator car at the point when the elevator car passes the edge of the door zone and to calculate on the basis of the calculated door zone velocity the distance of the stopped elevator car from the edge of the door zone.

11. The system according to claim 7, wherein the calculating means is arranged to monitor the recurrence of stoppages relative to the edge of the door zone.

12. The system according to claim 7, further comprising a transmitter arranged to transmit the results regarding the calculated stopping distances of the elevator car from the edge of the door zone over a wired or wireless connection to the condition monitoring system.

* * * * *

UNITED STATES PATENT AND TRADEMARK OFFICE

CERTIFICATE OF CORRECTION

PATENT NO. : 7,434,666 B2
APPLICATION NO. : 11/713677
DATED : October 14, 2008
INVENTOR(S) : Tapio Tyni et al.

It is certified that error appears in the above-identified patent and that said Letters Patent is hereby corrected as shown below:

On the title page, add item 30 as follows:

[30] Foreign Application Priority Data

September 27, 2004 [FI] Finland……...20041241.

Signed and Sealed this

Third Day of March, 2009

John Doll

JOHN DOLL
*Acting Director of the United States Patent and Trademark Office*